US006388635B1

(12) United States Patent
Nilsson

(10) Patent No.: US 6,388,635 B1
(45) Date of Patent: May 14, 2002

(54) FEEDER HORN, INTENDED ESPECIALLY FOR TWO-WAY SATELLITE COMMUNICATION

(75) Inventor: Mats Nilsson, Saltsjöbaden (SE)

(73) Assignee: C2Sat Communications AB, Nacka (SE)

( * ) Notice: Subject to any disclaimer, the term of this patent is extended or adjusted under 35 U.S.C. 154(b) by 0 days.

(21) Appl. No.: 09/850,737

(22) PCT Filed: Nov. 11, 1999

(86) PCT No.: PCT/SE99/02049

§ 371 Date: May 18, 2001

§ 102(e) Date: May 18, 2001

(87) PCT Pub. No.: WO00/31827

PCT Pub. Date: Jun. 2, 2000

(30) Foreign Application Priority Data

Nov. 25, 1998 (SE) ..... 9804041

(51) Int. Cl.[7] ..... H01Q 13/00

(52) U.S. Cl. ..... 343/786; 343/776; 333/135

(58) Field of Search ..... 343/753, 776, 343/786; 333/21 R, 21 A, 135, 137

(56) References Cited

U.S. PATENT DOCUMENTS 3,045,238 A * 7/1962 Cheston ..... 343/786
3,482,251 A * 12/1969 Brown, Jr. ..... 343/786
3,633,208 A * 1/1972 Ajioka ..... 343/786
4,090,203 A 5/1978 Duncan ..... 343/753
5,874,923 A * 2/1999 Nilsson et al. ..... 343/786
6,271,799 B1 * 8/2001 Rief et al. ..... 343/786

FOREIGN PATENT DOCUMENTS

| | | |
|---|---|---|
| SE | 503 456 | 1/1996 |
| WO | 9604693 | 2/1996 |

* cited by examiner

*Primary Examiner*—Tan Ho
(74) *Attorney, Agent, or Firm*—Jacobson Holman, PLLC

(57) ABSTRACT

A feeder horn intended particularly for two-way satellite communications equipment and including a central transceiver horn (10) and at least three separate measuring horns (11, 12, 13) placed symmetrically in relation to the feeder horn symmetry line (O), wherein all horns are produced mechanically in one and the same metal element (1) which includes a through-penetrating center opening (100) for the transceiver horn (10), a bottom-delimited opening (110, 130, 140) for each of the measuring horns (11, 12, 13), and a moat-like recess (104, 114, 124, 134) in the metal element (1) around each opening (100, 110, 120, 130) for insulating each horn electromagnetically in relation to other horns. The delimited opening (110, 120, 130) for each of the measuring horns in the metal element (1) is filled with dielectric material (1101, 1201, 1301). An adaptation lens (2) which includes a center hole (20) that is adapted to the center opening (100) of the transceiver horn (10) is arranged in front of the metal element (1).

1 Claim, 2 Drawing Sheets

FEEDER HORN, INTENDED ESPECIALLY FOR TWO-WAY SATELLITE COMMUNICATION

FIELD OF INVENTION

The present invention relates to a feeder horn, and more particularly to a feeder horn intended for two-way satellite communication and comprising a central transmitter/receiver horn and at least three separate measuring horns placed symmetrically in relation to the feeder horn.

BACKGROUND ART

A feeder horn of the aforesaid kind is known from Swedish Patent Specification 503456. All of the horns included in the feeder horn are produced mechanically in one and the same metal element, which includes a through-penetrating central opening for the transmitter/receiver horn, a bottom-delimited opening for each of the measuring horns, and a moat-like recess around each opening in the metal element for insulating each horn electromagnetically in relation to remaining horns.

Although feeder horns of this kind have been found to function extremely well in practice, attention is now being paid to the possibility of minimising the dimensions of waveguides in the feeder horn, so as to reduce the shadow on the aperture area of the reflector in the feeder horn.

SUMMARY OF THE INVENTION

In respect of a feeder horn of the aforementioned kind and constructed in accordance with the invention, the delimited opening for each of the measuring horns in the metal element is filled with a dielectric material. Moreover, an adaptation lens that has a centre hole adapted to the centre opening in the transmitter/receiver horn is arranged in front of the metal element.

These and other characteristic features of an inventive feeder horn will be more apparent from the accompanying claims.

BRIEF DESCRIPTION OF THE DRAWINGS

The invention will now be described in more detail with reference to the accompanying schematic drawings, in which.

DETAILED DESCRIPTION OF PREFERRED EMBODIMENTS

Figure 1:
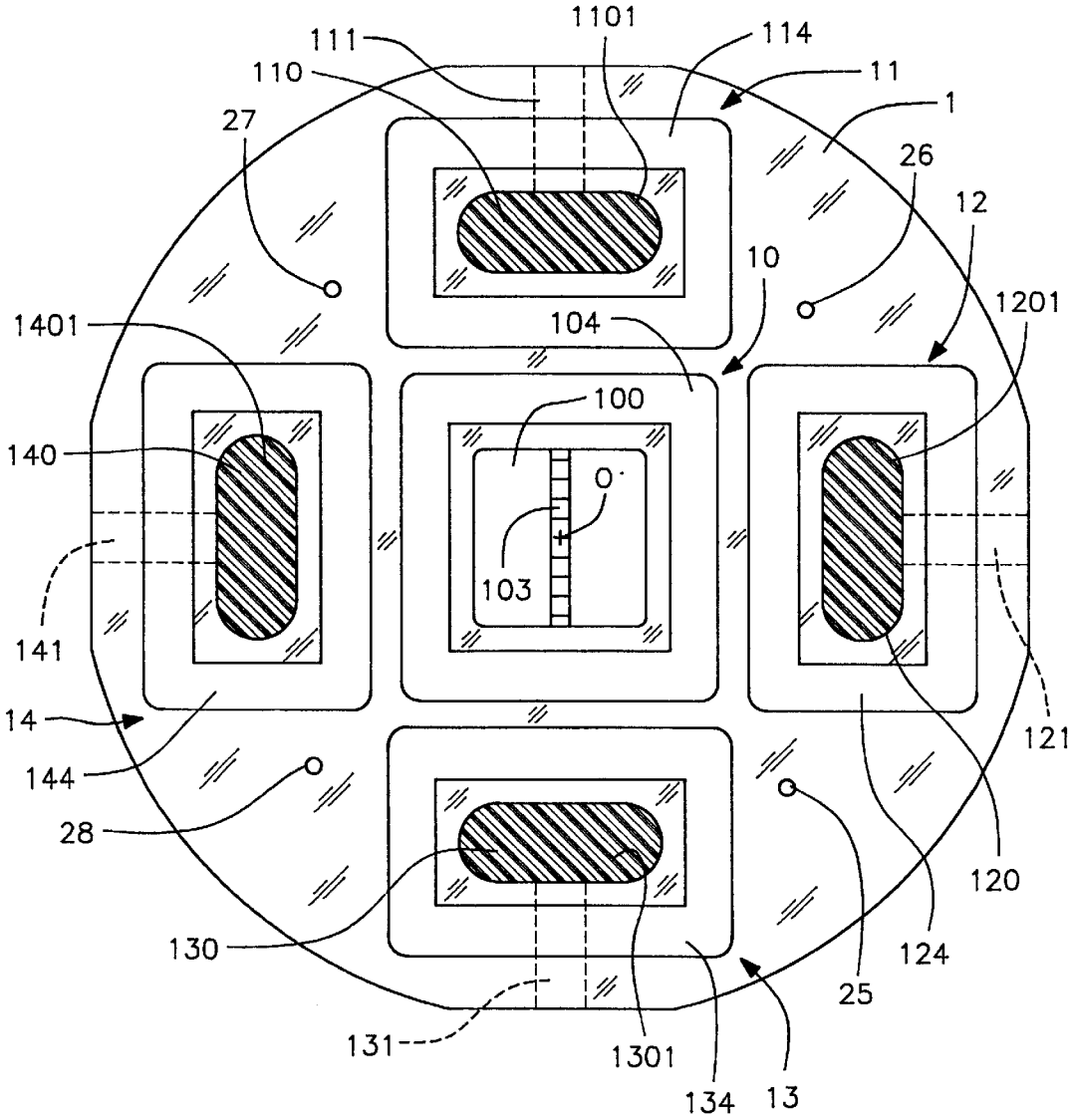
FIG. 1 illustrates an inventive feeder horn that includes four rectangular measuring horns.

The feeder horn according to FIG. 1 includes a central transceiver horn 10 and four separate measuring horns 11, 12, 13, 14 placed symmetrically in relation to the symmetry line O of the feeder horn 10 perpendicular to the plane of the drawing. All horns are produced mechanically in one and the same metal element 1.

The transceiver horn 10 has a through-penetrating centre opening 100 which merges with a transmitter waveguide and a receiver waveguide, said waveguides being separated by a filter 103 of the orthomode-transducer (OMT) type.

Each of the measuring horns 11, 12, 13, 14 in the metal element 1 has a bottom-delimited opening 110, 120, 130, 140.

A coupling device 111, 121, 131, 141, e.g. in the form of a measuring probe, is anchored in the metal element for each of the measuring horns.

The metal element also includes a moat-like recess 104, 114, 124, 134, 144 around respective openings 100, 110, 120, 130, 140 for insulating each horn electromagnetically in relation to other horns.

Figure 2:
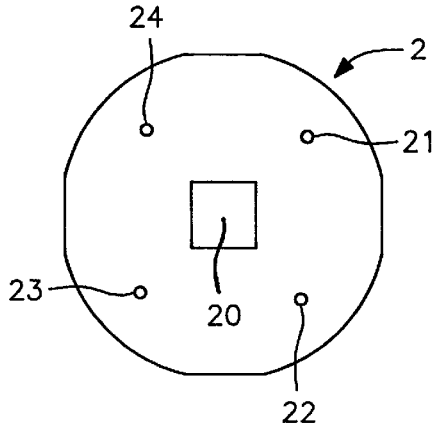
FIG. 2 illustrates an adaptation lens intended for the feeder horn shown in FIG. 1.

With the intention of minimising the dimensions of the feeder horn and therewith reduce the shadowing effect of the feeder horn on the associated reflector aperture area without negatively influencing the insulation and the amplification effect, the bottom-delimited opening 110, 120, 130, 140 for each of the measuring horns in the metal element 1 is filled with dielectric material 1101, 1201, 1301, 1401. Attached to the metal element 1 is an adaptation lens (FIG. 2) which includes a centre hole 20 that is adapted to the centre opening 100 of the transceiver horn 10. The dielectric material may comprise, e.g., quartz ($SiO_2$), aluminium ($Al_2O_3$) or a polytetrafluoroethylene plastic (PTFE) retailed under the trademark Teflon®. Pieces of the dielectric material are machined to precisely match the shape and extension of the delimited openings 110, 120, 130, 140. These machined pieces are fastened directly in the feeder horn, e.g. glued therein.

The adaptation lens 2 is fastened directly to the feeder horn, e.g. with the aid of four pins 21–24 that project out from the underside of the lens and fit into holes 25–28 in the metal element.

Figure 3:
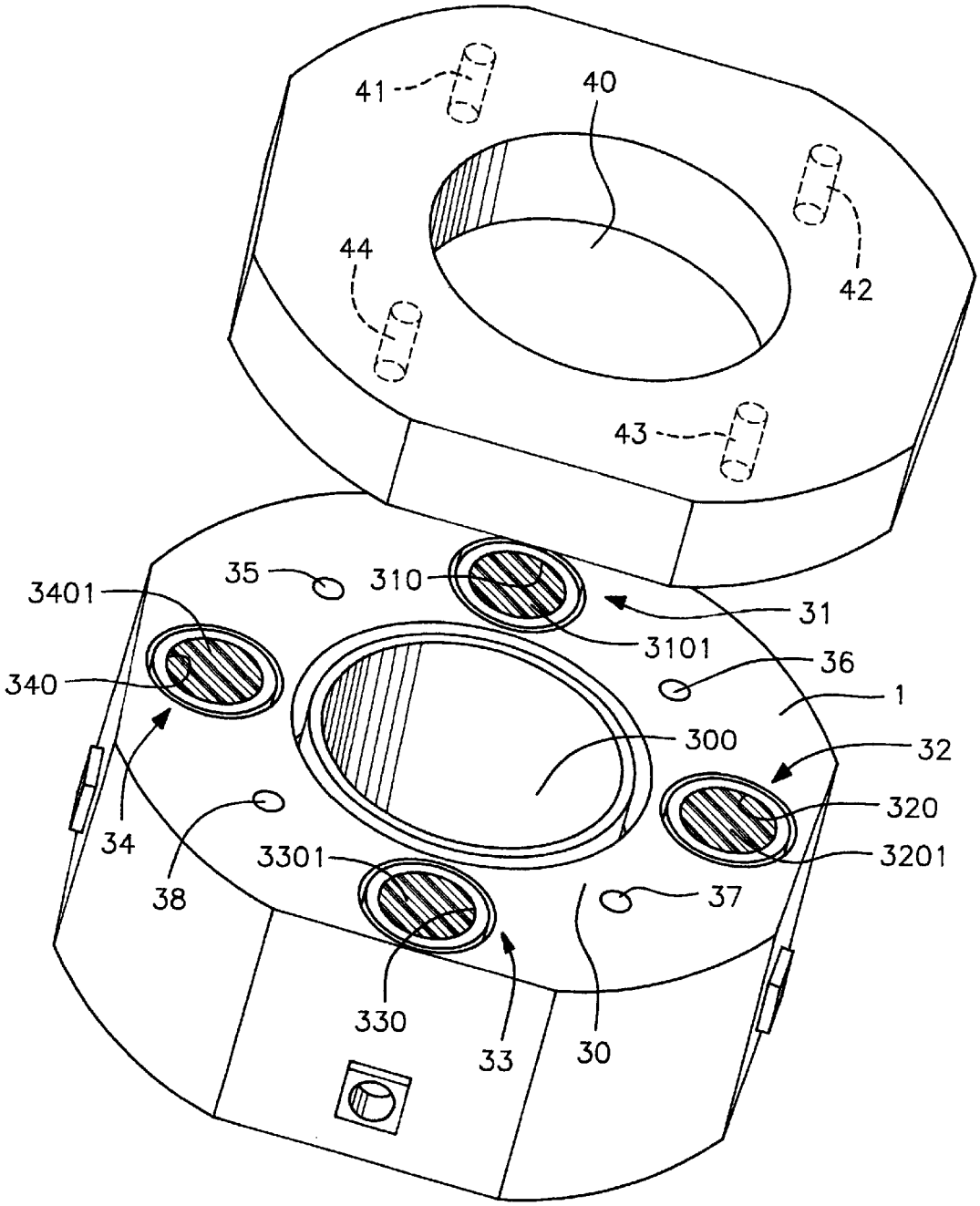
FIG. 3 illustrates a feeder horn that includes four circular measuring horns and an adaptation lens.

The feeder horn illustrated in FIG. 3 includes a transceiver horn 30 mounted in a metal element 1 and having a circular, through-penetrating centre opening 300 and four separate measuring horns 31–34, each of which has a bottom-delimited circular opening 310, 320, 330, 340 in the metal element. These delimited openings are filled with dielectric material 3101, 3201, 3301, 3401 (cylindrical plugs). Located in the metal element 1 between the measuring horns 31–34 are four holes 35–38 for receiving respective pins 41–44 disposed on the underside of an adaptation lens 4. This lens has a circular centre hole 40 which is adapted to the centre opening 300 of the transceiver horn and which shall be fastened immediately adjacent to and on the upper side of the metal element 1 with the aid of pins.

The dielectric quartz material has a dielectric constant, or permittivity $\in=3.8$. The Teflon® adaptation lens will have a dielectric constant $\in=2.7$. These materials function particularly well within the frequency range 1.5–40 GHz and in the temperature range +10° C.–+30° C.

What is claimed is:

1. A feeder horn intended particularly for two-way satellite communications equipment and including a central transceiver horn (10) and at least three separate measuring horns (11, 12, 13) placed symmetrically in relation to the feeder horn symmetry line (O), wherein all horns are produced mechanically in one and the same metal element (1) which includes a through-penetrating centre opening (100) for the transceiver horn (10), a bottom-delimited opening (110, 130, 140) for each of the measuring horns (11, 12, 13), and a moat-like recess (104, 114, 124, 134) in the metal element (1) around each opening (100, 110, 120, 130) for insulating each horn electromagnetically in relation to other horns, characterised in that the delimited opening (110, 120, 130) for each of the measuring horns in the metal element (1) is filled with dielectric material (1101, 1201, 1301); and in that an adaptation lens (2) which includes a centre hole (20) that is adapted to the centre opening (100) of the transceiver horn (10) is arranged in front of the metal element (1).

* * * * *